US009163837B2

(12) United States Patent
Sutcu et al.

(10) Patent No.: US 9,163,837 B2
(45) Date of Patent: Oct. 20, 2015

(54) FLOW CONDITIONER IN A COMBUSTOR OF A GAS TURBINE ENGINE

(71) Applicants: Muzaffer Sutcu, Oviedo, FL (US); John M. Crane, Oviedo, FL (US); Mouna Lamnaouer, Orlando, FL (US)

(72) Inventors: Muzaffer Sutcu, Oviedo, FL (US); John M. Crane, Oviedo, FL (US); Mouna Lamnaouer, Orlando, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 366 days.

(21) Appl. No.: 13/778,769

(22) Filed: Feb. 27, 2013

(65) Prior Publication Data

US 2014/0238029 A1 Aug. 28, 2014

(51) Int. Cl.

| | |
|---|---|
| ***F23R 3/06*** | (2006.01) |
| ***F23R 3/10*** | (2006.01) |
| ***F23R 3/26*** | (2006.01) |
| ***F23R 3/46*** | (2006.01) |
| ***F23R 3/54*** | (2006.01) |
| *F01D 9/02* | (2006.01) |

(52) U.S. Cl.

CPC ... *F23R 3/06* (2013.01); *F23R 3/10* (2013.01); *F23R 3/26* (2013.01); *F23R 3/46* (2013.01); *F23R 3/54* (2013.01); *F01D 9/023* (2013.01); *F23R 2900/00014* (2013.01)

(58) Field of Classification Search

CPC ..... F23R 3/00; F23R 3/002; F23R 3/02; F23R 3/04; F23R 3/06; F23R 3/10; F23R 3/16; F23R 3/54; F01D 9/023

See application file for complete search history.

(56) References Cited

U.S. PATENT DOCUMENTS

| | | | | |
|---|---|---|---|---|
| 4,719,748 | A | 1/1988 | Davis, Jr. et al. | |
| 4,903,477 | A | 2/1990 | Butt | |
| 5,363,653 | A | 11/1994 | Zimmermann et al. | |
| 6,615,588 | B2 | 9/2003 | Hoecker | |
| 7,010,921 | B2 | 3/2006 | Intile et al. | |
| 7,617,684 | B2 | 11/2009 | Norster | |
| 7,685,823 | B2 | 3/2010 | Martling et al. | |
| 7,707,835 | B2 | 5/2010 | Lipinski et al. | |
| 8,096,133 | B2 | 1/2012 | Hessler et al. | |
| 2008/0041058 | A1 * | 2/2008 | Johnson et al. | 60/725 |
| 2010/0064693 | A1 * | 3/2010 | Koenig et al. | 60/760 |
| 2011/0247339 | A1 * | 10/2011 | Chila et al. | 60/752 |
| 2012/0006029 | A1 | 1/2012 | Bilbao et al. | |

FOREIGN PATENT DOCUMENTS

| | | | |
|---|---|---|---|
| EP | 2375161 | A2 | 10/2011 |
| WO | 2010030309 | A2 | 3/2010 |

* cited by examiner

*Primary Examiner* — Craig Kim

(57) ABSTRACT

A combustor in a gas turbine includes a liner having an interior volume defining a main combustion zone, a fuel injection system for delivering fuel into the main combustion zone, and a flow sleeve that defines, with the liner, a passageway for air to flow on its way to be mixed with fuel from the fuel injection system, wherein the mixture is burned in the main combustion zone to create hot combustion gases. The combustor further includes a flow conditioner including at least one panel having a configuration such that air is able to pass through the panel(s) on its way to the passageway, wherein at least a substantial portion of the air that enters the passageway for being burned in the main combustion zone passes through the panel(s).

17 Claims, 8 Drawing Sheets

FLOW CONDITIONER IN A COMBUSTOR OF A GAS TURBINE ENGINE

FIELD OF THE INVENTION

The present invention relates to a flow conditioner in a combustor of a gas turbine engine, wherein the flow conditioner includes a plurality of panels through which air flows on its way to be burned with fuel in the combustor.

BACKGROUND OF THE INVENTION

During operation of a gas turbine engine, air is pressurized in a compressor section then mixed with fuel and burned in a combustion section to generate hot combustion gases. In a can annular gas turbine engine, the combustion section comprises an annular array of combustor apparatuses, sometimes referred to as "cans", which each supply hot combustion gases to a turbine section of the engine where the hot combustion gases are expanded to extract energy from the combustion gases to provide output power used to produce electricity.

SUMMARY OF THE INVENTION

In accordance with a first aspect of the present invention, a combustor is provided in a gas turbine comprising a liner having an interior volume defining a main combustion zone, a fuel injection system for delivering fuel into the main combustion zone, and a flow sleeve located radially outwardly from the liner. The flow sleeve defines with the liner a passageway for air to flow on its way to be mixed with fuel from the fuel injection system, wherein the mixture is burned in the main combustion zone to create hot combustion gases. The combustor further comprises a transition assembly including a transition duct located downstream from the liner with respect to a flow direction of the hot combustion gases out of the combustor toward a turbine section of the engine, wherein the flow direction of the hot combustion gases defines an axial direction. The combustor still further comprises a flow conditioner affixed to at least one of the liner and the transition assembly and extending to within close proximity of the flow sleeve but not coupled to the flow sleeve. The flow conditioner comprises at least one panel having a configuration such that air is able to pass through the at least one panel on its way to the passageway, wherein at least a substantial portion of the air that enters the passageway for being burned in the main combustion zone passes through the at least one panel.

In accordance with a second aspect of the present invention, a combustor is provided in a gas turbine engine comprising a flow sleeve, a fuel injection system, and flow path structure defining a flow path for hot combustion gases to pass from the combustor into a turbine section of the engine. The flow path structure comprises a liner and a transition assembly. The liner has an interior volume defining a main combustion zone and is located radially inwardly from the flow sleeve. The liner defines with the flow sleeve a passageway for air to flow on its way to be mixed with fuel from the fuel injection system, wherein the mixture is burned in the main combustion zone to create hot combustion gases. The transition assembly comprises a transition duct located downstream from the liner with respect to a flow direction of the hot combustion gases through the flow path, wherein the flow direction of the hot combustion gases defines an axial direction. The combustor further comprises a flow conditioner affixed to one of the flow path structure and the flow sleeve and extending to within close proximity of but not affixed to the other of the flow path structure and the flow sleeve. The flow conditioner comprises a frame and a plurality of panels secured to the frame and having configurations such that air is able to pass through the panels on its way to the passageway. At least a substantial portion of the air that enters the passageway passes through the panels, and the panels are removably secured to the frame such that the panels are capable of being removed and replaced without detaching the flow conditioner from the one of the flow path structure and the flow sleeve.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
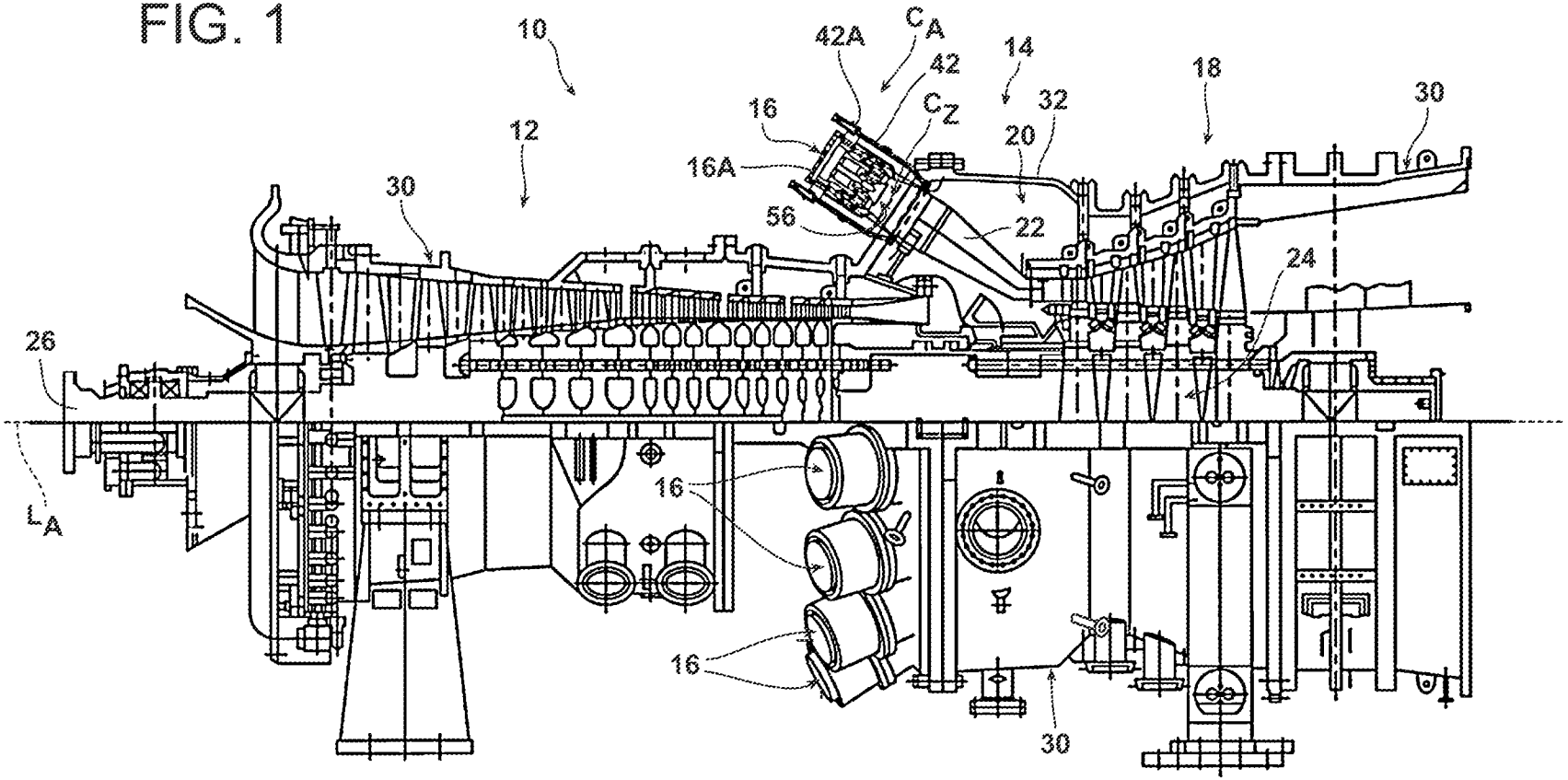
FIG. 1 is a side view, partially in section, of a gas turbine engine including a plurality of combustors according to an embodiment of the invention.

Referring to FIG. 1, a gas turbine engine 10 constructed in accordance with the present invention is shown. The engine 10 includes a compressor section 12, a combustion section 14 including a combustor assembly $C_A$ comprising a plurality of combustors 16, and a turbine section 18. It is noted that the combustor assembly $C_A$ according to the present invention preferably comprises an annular array of combustors 16 that are disposed about a longitudinal axis $L_A$ of the engine 10 that defines an axial direction within the engine 10. Such a configuration is typically referred to as a "can-annular combustor assembly."

The compressor section 12 inducts and pressurizes inlet air, at least a portion of which is directed to a combustor shell 20 for delivery to the combustors 16. The air in the combustor shell 20 is hereinafter referred to as "shell air". Other portions of the pressured air may be extracted from the combustion section 12 to cool various components within the engine 10. For example, pressurized air may be bled off from the compressor section 12 and delivered to components in the turbine section 18.

Upon entering the combustors 16, the compressed air from the combustor shell 20 is mixed with fuel and ignited in a main combustion zone $C_Z$ to produce high temperature combustion gases flowing in a turbulent manner and at a high velocity within the respective combustor 16. The combustion gases in each combustor 16 then flow through a respective transition duct 22 (only one transition duct 22 is shown in FIG. 1) to the turbine section 18 where the combustion gases are expanded to extract energy therefrom. A portion of the energy extracted from the combustion gases is used provide rotation of a turbine rotor 24, which extends parallel to a rotatable shaft 26 that extends axially through the engine 10 along the longitudinal axis $L_A$.

As shown in FIG. 1, an engine casing 30 is provided to enclose the respective engine sections 12, 14, 18. The portion of the casing 30 surrounding the combustion section 14 comprises a casing wall 32 that defines the combustor shell 20, i.e., the combustor shell 20 defines an interior volume within the portion of the casing 30 that surrounds the combustion section 14.

Figure 2:
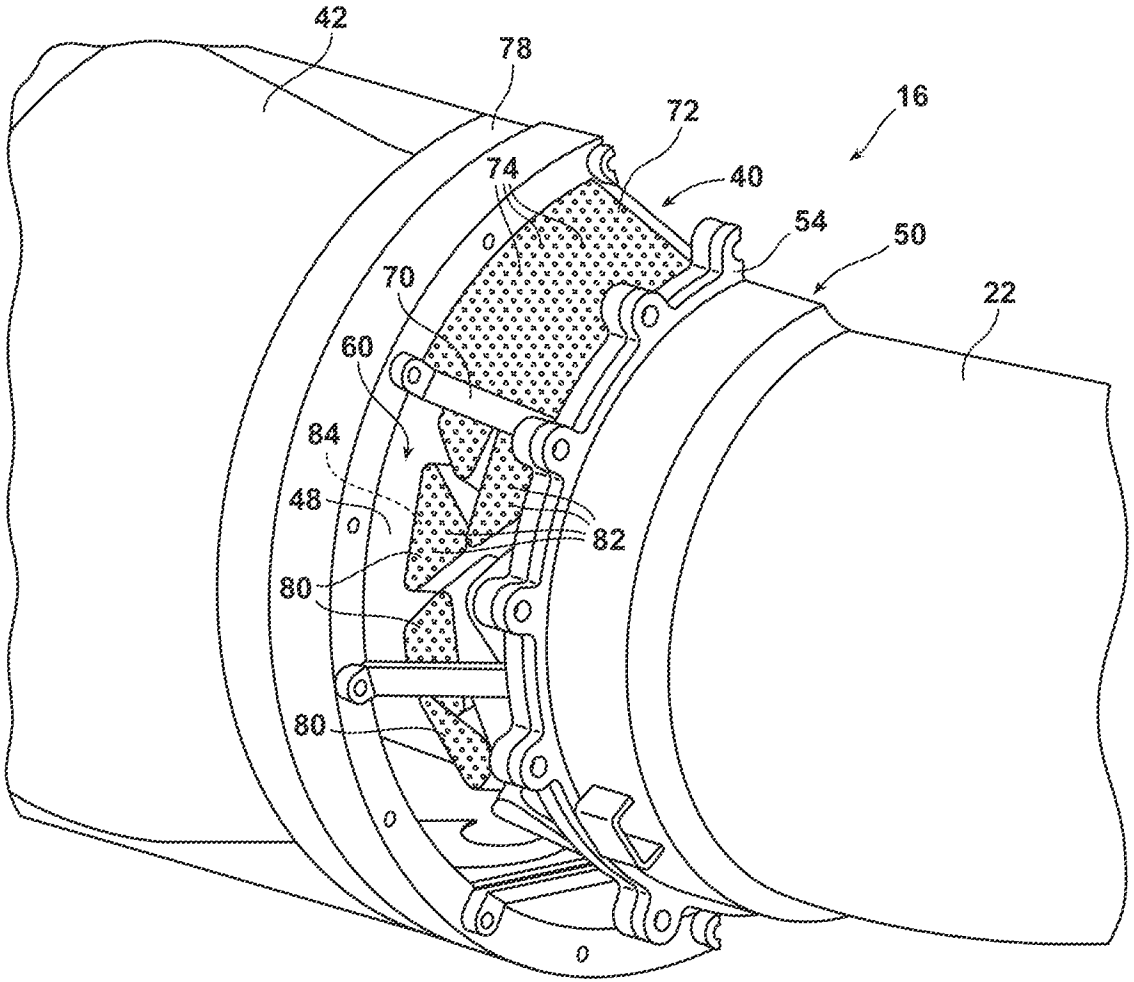
FIG. 2 is a perspective view of a portion of a combustor included in the engine of FIG. 1 and including a flow conditioner in accordance with an aspect of the invention.
Figure 3:
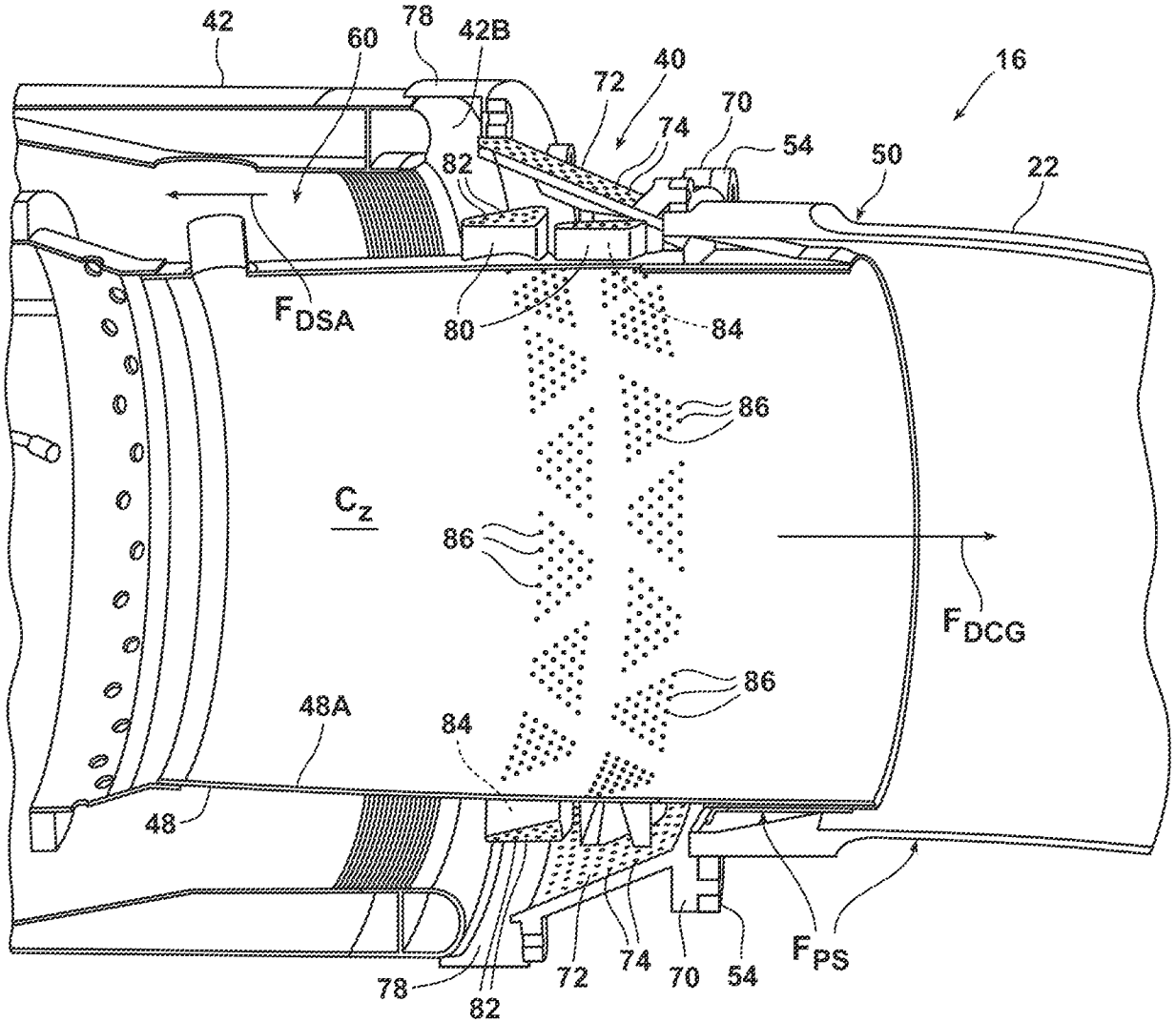
FIG. 3 is a side cross sectional view illustrating a portion of the combustor and flow conditioner of FIG. 2.

Referring to FIGS. 2 and 3, one of the combustors 16 of the combustor assembly $C_A$ illustrated in FIG. 1 and a flow conditioner 40 for providing shell air to the combustion zone $C_Z$ of the combustor 16 will now be described. It is noted that while only one combustor 16 and flow conditioner 40 are illustrated in FIGS. 2 and 3, the remaining combustors 16 in the combustor assembly $C_A$ would also include a similar or identical flow conditioner 40 to the one illustrated in FIGS. 2 and 3 and described herein.

The combustor 16 comprises a flow sleeve 42, a liner 48 that includes an interior volume 48A that defines the combustion zone $C_Z$ (see FIG. 3) where the fuel and shell air are mixed and burned to create the hot working gas, a transition assembly 50 comprising the transition duct 22 and a transition ring 54 comprising an annular member that extends radially outwardly from the transition duct 22, and a fuel injection system 56 (see FIG. 1) that is provided to deliver fuel into the combustion zone $C_Z$. The transition duct 22 is coupled to the liner 48 for delivering the hot working gas to the turbine section 18, i.e., as shown in FIG. 3, the transition duct 22 is positioned downstream from the liner 48 with respect to a flow direction $F_{DCG}$ of the hot combustion gases out of the combustor 16 toward the turbine section 18, wherein the flow direction $F_{DCG}$ of the hot combustion gases defines an axial direction. It is noted that the liner 48 and the transition assembly 50 are collectively referred to herein as "flow path structure $F_{PS}$," wherein the flow path structure $F_{PS}$ defines a flow path for the hot combustion gases to pass from the combustor 16 into the turbine section 18 of the engine 10.

Referring to FIG. 3, the flow sleeve 42 in the embodiment shown comprises a generally cylindrical member that defines an outer boundary for a passageway 60 through which the shell air to be delivered into the combustion zone $C_Z$ flows. The flow sleeve 42 is located radially outwardly from the liner 48 such that the passageway 60 is defined radially between the flow sleeve 42 and the liner 48. The flow sleeve 42 includes a first end 42A affixed to the engine casing 32 at a head end 16A of the combustor 16 (see FIG. 1) and a second end 42B distal from the first end 42A.

In the illustrated embodiment, the fuel injection system 56 comprises a central pilot fuel injector and an annular array of main fuel injectors disposed about the pilot fuel injector, see FIG. 1. However, the fuel injection system 56 could include other configurations without departing from the spirit and scope of the invention. The pilot fuel injector and the main fuel injectors each deliver fuel into the combustion zone $C_Z$ during operation of the engine 10.

Referring to FIGS. 2 and 3, the flow conditioner 40 is positioned radially between the flow path structure $F_{PS}$ and the flow sleeve 42. In the embodiment shown, the flow conditioner 40 comprises an annular member that extends from the transition ring 54 toward the flow sleeve 42 and comes in close proximity to the second end 42B of the flow sleeve 42 but is not coupled to the flow sleeve 42. It is noted that the flow conditioner 40 could extend from other components of the flow path structure $F_{PS}$ instead of the transition ring 54. For example, the flow conditioner 40 could extend toward the flow sleeve 42 from a portion of the liner 48, as, for example, in the embodiments illustrated in FIGS. 6 and 7, which will be discussed below, or from the transition duct 22, or the flow conditioner 40 could extend from the flow sleeve 42 toward the flow path structure $F_{PS}$, as in the embodiment illustrated in FIG. 5, which will be discussed below.

Figure 4:
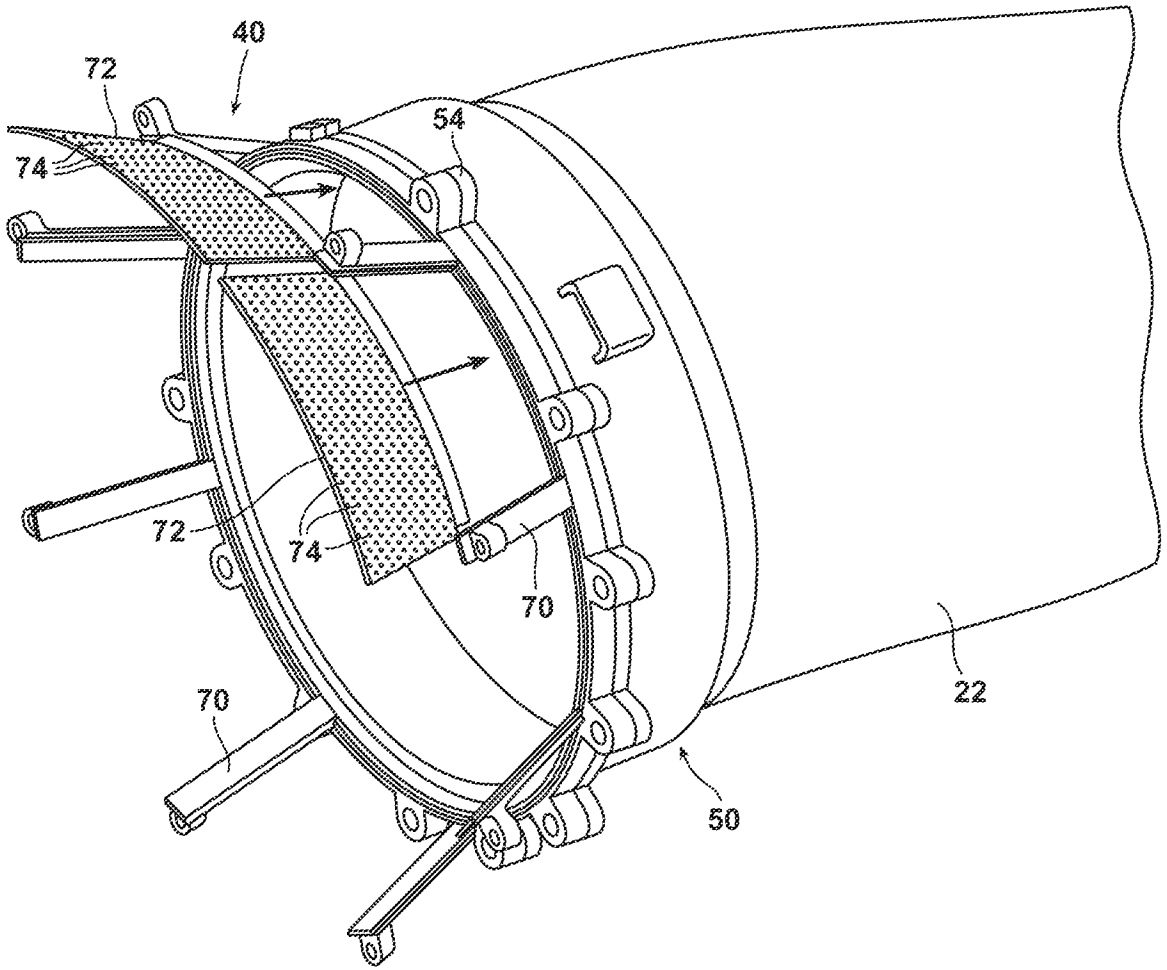
FIG. 4 is a perspective view illustrating a step used during assembly of the flow conditioner shown in FIGS. 2 and 3.

The flow conditioner 40 defines an inlet for shell air passing into the passageway 60 and comprises a frame 70 that is secured to and extends from the transition ring 54, and a plurality of replaceable panels 72 removably secured within the frame 70 (it is noted that some of the panels 72 have been removed from FIG. 2 so the structure located radially inwardly from the panels 72 can be seen in FIG. 2). According to an aspect of the present invention, the panels 72 have a configuration such that air is able to pass through the panels 72 on its way to the passageway 60, wherein each panel 72 may be selected with a desired air permeability such that an amount of air permitted to flow through the respective panel 72 can be controlled. Referring to FIG. 4, since the panels 72 are removably secured within the frame 70 by sliding the panels 72 generally axially such that they are received in the frame 70, the panels 72 are capable of being removed and replaced without detaching the frame 70 from the transition ring 54 and without detaching the transition ring 54 form the transition duct 72.

In the exemplary embodiment illustrated in FIGS. 2-4, the panels 72 include a plurality of holes 74, wherein the shell air that enters the passageway 60 though the panels 72 passes through the holes 74. According to an aspect of the invention, each panel 72 can be selected with a desired hole configuration such that the amount of air permitted to flow through each respective panel 72 on its way to the passageway 60 can be controlled. For example, sizes, shapes, locations, and/or orientations of the holes 74 could be varied to control the amount of air permitted to pass through the respective panel 72. It is noted that while the panels 72 in the illustrated embodiment include generally round holes 74, panels having other configurations that allow air to pass therethrough could be used, such as, for example, elliptical holes, slots, mesh panels, perforated panels, or rolled, thin panels with encapsulated wire. It is also noted that not all the panels 72 included in the flow conditioner 40 are required to have the same hole configuration. That is, one or more of the panels 72 may include hole configurations that are different from the other panels 72.

As shown in FIGS. 2 and 3 the flow conditioner 40 further comprises a flange 78 that extends from the frame 70 and radially overlaps the flow sleeve 42. The flange 78 is in close proximity to the second end 42B of the flow sleeve 42 but is not coupled to the flow sleeve 42 such that the flange 78 and the flow sleeve 42 cooperate to create a seal to substantially prevent leakage therebetween. Hence, while at least a substantial portion of the shell air that enters the passageway 60 for being burned in the main combustion zone $C_Z$ passes through the holes 74 in the panels 72, substantially all of the shell air that enters the passageway 60 for being burned in the main combustion zone $C_Z$ either passes through the holes 74 in the panels 72 or leaks between the flange 78 and the second end 42B of the flow sleeve 42. It is noted that the flange 78 is preferably bolted to the frame 70 such that the flange 78 can be easily removed if one or more of the panels 72 are to be replaced.

Referring still to FIGS. 2 and 3, the combustor 16 further comprises a plurality of resonator boxes 80 that extend radially outwardly from the liner 48 into the passageway 60. In the embodiment shown in FIGS. 2 and 3, the resonator boxes 80 are located downstream from the flow conditioner 40 with respect to a flow direction $F_{DSA}$ of the shell air into the passageway 60 (see FIG. 3), although the resonator boxes 80 could be located upstream from the flow conditioner 40 with respect to the shell air flow direction $F_{DSA}$, as in the embodiment of FIG. 5, which will be discussed below.

The resonator boxes 80 include apertures 82 (see FIG. 2), which allow a portion of the air in the passageway 60 to flow into inner volumes 84 within the resonator boxes 80. The air in the inner volumes 84 of the resonator boxes 80 then flows into the interior volume 48A of the liner 48 through apertures 86 formed in the liner 48, see FIG. 3. The flow of the portion of shell air into and through the resonator boxes 80 attenuates vibrations in the combustor 16, as will be apparent to those skilled in the art.

During operation of the engine 10, shell air, which comprises compressed air from the compressor section 12 that flows into the combustor shell 20 as discussed above, enters the passageway 60 from the combustor shell 20 through the holes 74 in the panels 72 of the flow conditioner 40. It has been determined that certain components within the combustor 16, such as, for example, feed pipes, support legs, etc. (not shown), may affect the amount of shell air that is available for passage into the passageway 60 at locations corresponding to one or more of the panels 72. Hence, according to the present invention, each of the panels 72 can be selected with a desired air permeability such that the amount of shell air permitted to pass through each panel 72 can be controlled, such that a generally uniform amount of shell air can be arranged to flow into the passageway 60 through each panel 72. Creating a generally uniform amount of shell airflow into the passageway 60 through the panels 72 is advantageous, as it provides a substantially equal airflow pattern for each of the main fuel injectors, thus effecting a more focused and controlled combustion gas production within each combustor 16.

As will be apparent to those having ordinary skill in the art, the resonator boxes 80 are tuned for suppressing specific sound frequencies. As there is only space for a limited number of resonator boxes 80 in the combustor 16, only the highest risk frequencies are selected for suppression, wherein resonator tuning is accomplished by adjusting the internal pressure within the inner volume 84 of each respective resonator box 80 as well as by selecting the size of the inner volume 84, and also by tailoring the sizes of the apertures 86 formed in the liner 48. In accordance with this embodiment, since the resonator boxes 80 are located downstream from the flow conditioner 40 with respect to the flow direction $F_{DSA}$ of the shell air into the passageway 60, a generally uniform amount of shell air pressure can be provided to each of the resonator boxes 80, such that each of the resonator boxes 80 is able to function in accordance with its designed tuning parameters.

Additionally, since the panels 72 are removable from the flow conditioner 40 without detaching the frame 70 from the transition ring 54 and without detaching the transition ring 54 from the transition duct 22, an efficiency is increased for replacing the panels 72, which may be replaced due to damage or to adjust the air permeability of the respective panel 72, as discussed above.

Moreover, since the flow conditioner 40 according to this embodiment is coupled to the transition assembly 50, i.e., to the transition ring 54, but not to the flow sleeve 42 or to the liner 48, internal stresses of these respective components caused by differing amounts of thermal growth are reduced or avoided. That is, during operation of the engine 10, the flow sleeve 42, the liner 48, and the transition duct 54 may thermally expand and contract differently. This is caused, at least in part, by the creation of hot combustion gases in the main combustion zone $C_Z$, which is defined in the interior volume 48A of the liner 48. Hence, the liner 48 and the transition duct 54, which conveys the hot combustion gases to the turbine section 18 of the engine 10, reach a much higher temperature than the flow sleeve 42, which is not directly exposed to the hot combustion gases during engine operation. Further, the flow sleeve 42, the liner 48, and the transition duct 54 may be formed from different materials having different coefficients of thermal expansion. The different coefficients of thermal expansion and the different operating temperatures of the flow sleeve 42, the liner 48, and the transition duct 54 may result in different rates and amounts of thermal expansion and contraction of these components during engine operation. Because the flow conditioner 40 according to this embodiment of the invention is coupled to the transition assembly 50 but not to the flow sleeve 42 or the liner 48, internal stresses caused by these components thermally expanding at different rates and amounts, which would otherwise cause pulling/pushing of these components against one another, are believed to be substantially reduced or avoided by the current invention.

Once the shell air enters the passageway 60 through the flow conditioner 40, the air flows through the passageway 60 in the flow direction $F_{DSA}$ away from the second end 42B of the flow sleeve 42 toward the head end 16A of the combustor 16, i.e., away from the turbine section 18 and toward the compressor section 12. Upon the air reaching the head end 16A of the combustor 16 at an end of the passageway 60, the air turns generally 180 degrees to flow into the combustion zone $C_Z$ in a direction away from the head end 16A of the combustor 16, i.e., toward the turbine section 18 and away from the compressor section 12. The air is mixed with fuel provided by the fuel injection system 56 and burned to create a hot working gas as described above.

Figure 5:
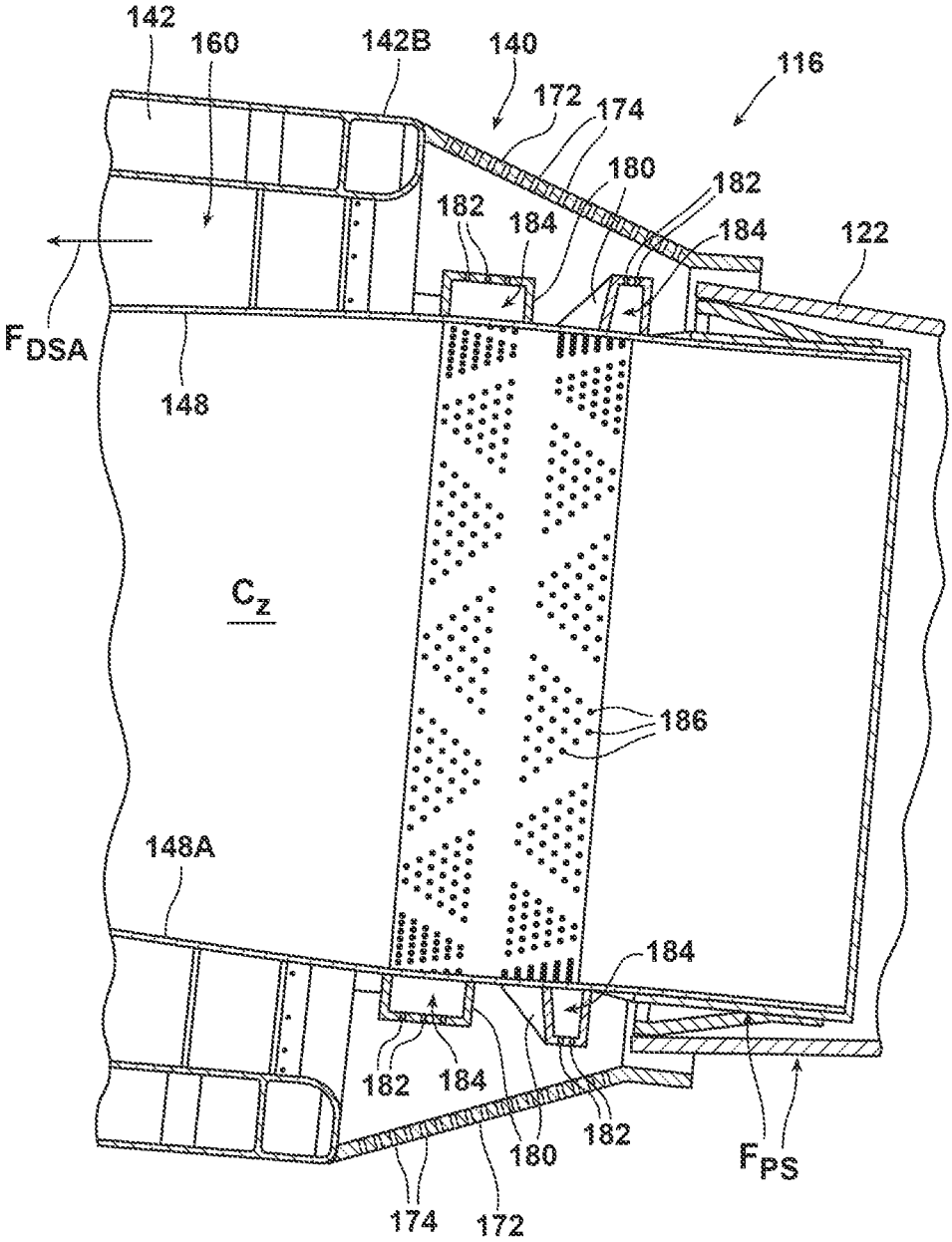
FIGS. 5-8 are side cross sectional views of portions of combustors including flow conditioners in accordance with other embodiments of the invention.

Referring now to FIG. 5, a flow conditioner 140 according to another embodiment of the invention is illustrated, where structure similar to that described above with reference to FIGS. 1-4 includes the same reference number increased by 100. It is noted that only components of the combustor 116 that are different than those of the combustor 16 described above with reference to FIGS. 1-4 will be described herein for FIG. 5.

According to this embodiment, the flow conditioner 140 extends from the second end 1428 of the flow sleeve 142 toward the flow path structure $F_{PS}$ but is not coupled to the flow path structure $F_{PS}$. Hence, thermal growth issues, such as those described above with reference to the embodiment of FIGS. 1-4, are believed to be reduced or avoided by the flow conditioner 140 according to this embodiment.

The flow conditioner 140 according to this embodiment may also comprise a frame (not shown in this embodiment) that supports a plurality of panels 172. The panels 172 may each be selected with a desired air permeability as described above with reference to the embodiment of FIGS. 1-4.

Figure 6:
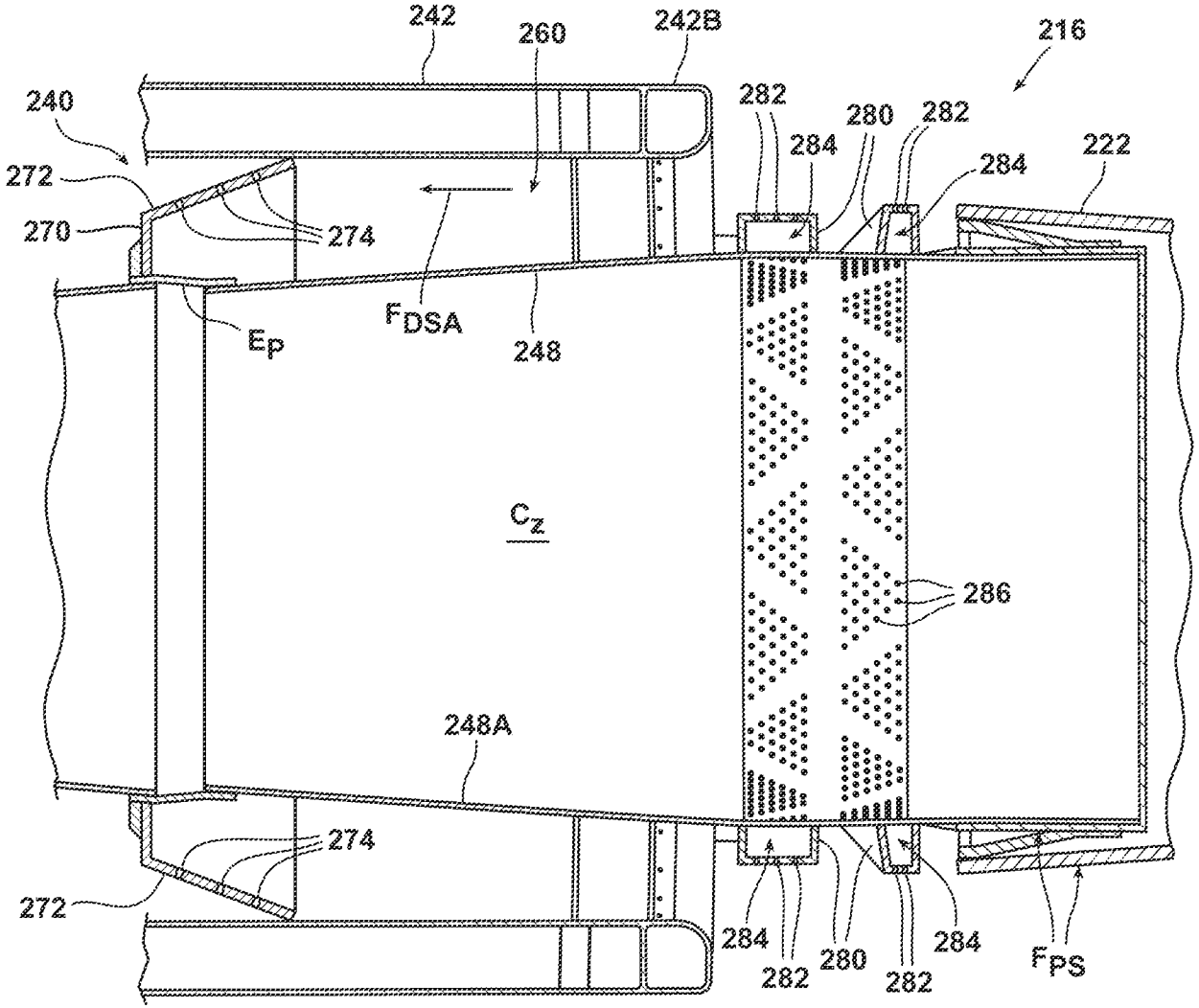
Figure 7:
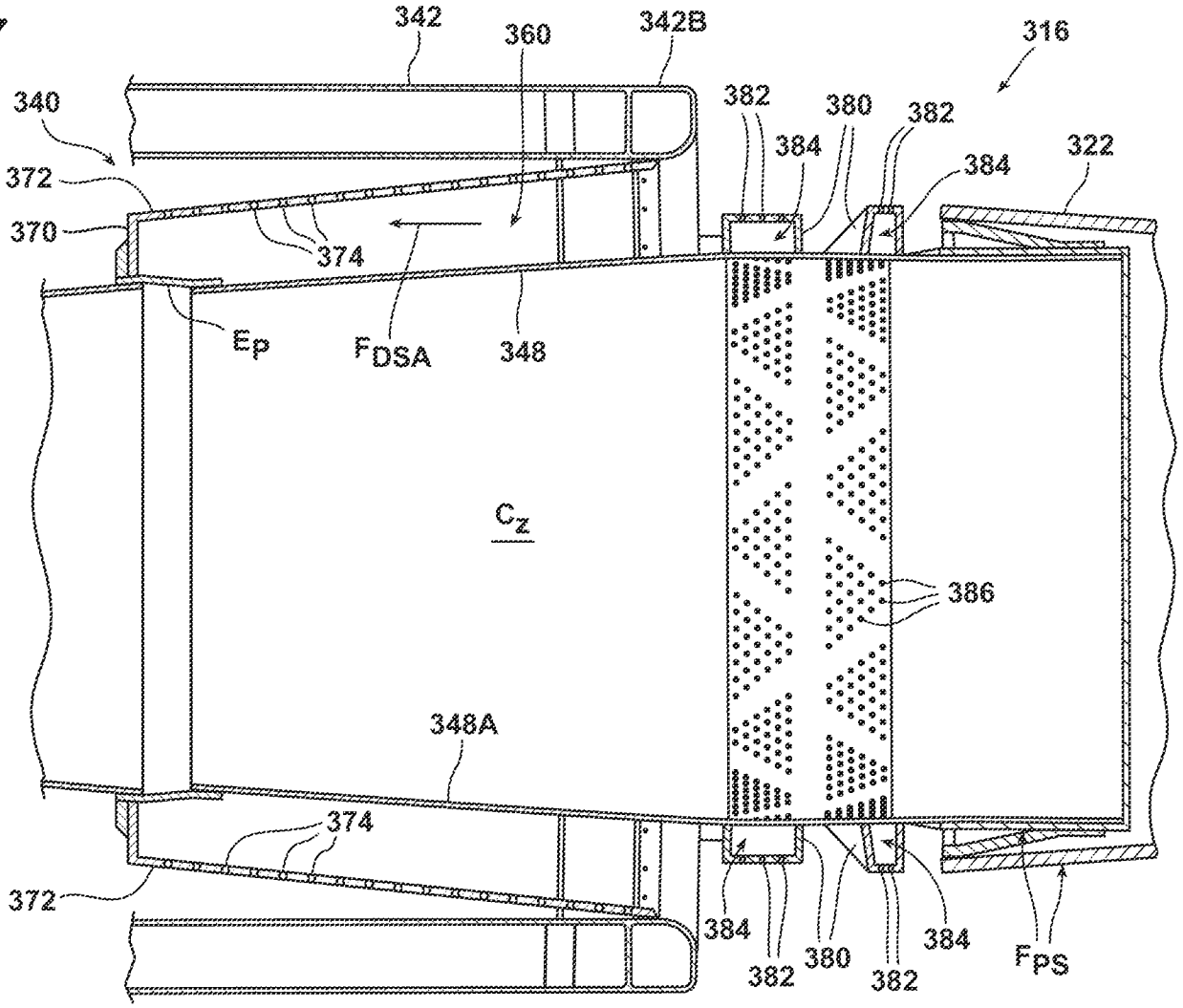

Referring now to FIGS. 6 and 7, flow conditioners 240, 340 according to other embodiments of the invention are illustrated, where structure similar to that described above with reference to FIGS. 1-4 includes the same reference number increased by 200 in FIG. 6 and increased by 300 in FIG. 7. It is noted that only components of the combustors 216, 316 that are different than those of the combustor 116 described above with reference to FIG. 5 will be described herein for FIGS. 6 and 7, and that the fuel injection system 256 has been removed from FIGS. 6 and 7 for clarity.

According to this embodiment, the flow conditioners 240, 340 extend from an extension piece $E_P$ of the liner 248, 348 toward the flow sleeves 242, 342, such that the flow conditioners 240, 340 are effectively affixed to the respective liners 248, 348 but are not coupled to the flow sleeves 242, 342. Hence, thermal growth issues, such as those described above with reference to the embodiment of FIGS. 1-4, are believed to be reduced or avoided by the flow conditioners 240, 340 according to this embodiment.

Further, the resonator boxes 280, 380 according to these embodiments extend radially outwardly from the liners 248, 348 upstream from the respective flow conditioners 240, 340 with respect to flow directions $F_{DSA}$ of the shell air into the respective passageways 260, 360. While the amount of shell air that is provided to each of the resonator boxes 280, 380 according to these embodiments is not able to be controlled by the respective flow conditioners 240, 340 as precisely as in the embodiments of FIGS. 1-5 discussed above, the amount of shell air that is provided to each of the resonator boxes 280, 380 according to these embodiments is believed to be controlled more precisely than if no flow conditioners were provided.

The flow conditioners 240, 340 according to this embodiment may also comprise a frame 270, 370 that supports a plurality of panels 272, 372. The panels 272, 372 may each be selected with a desired air permeability as described above with reference to the embodiment of FIGS. 1-4.

Figure 8:
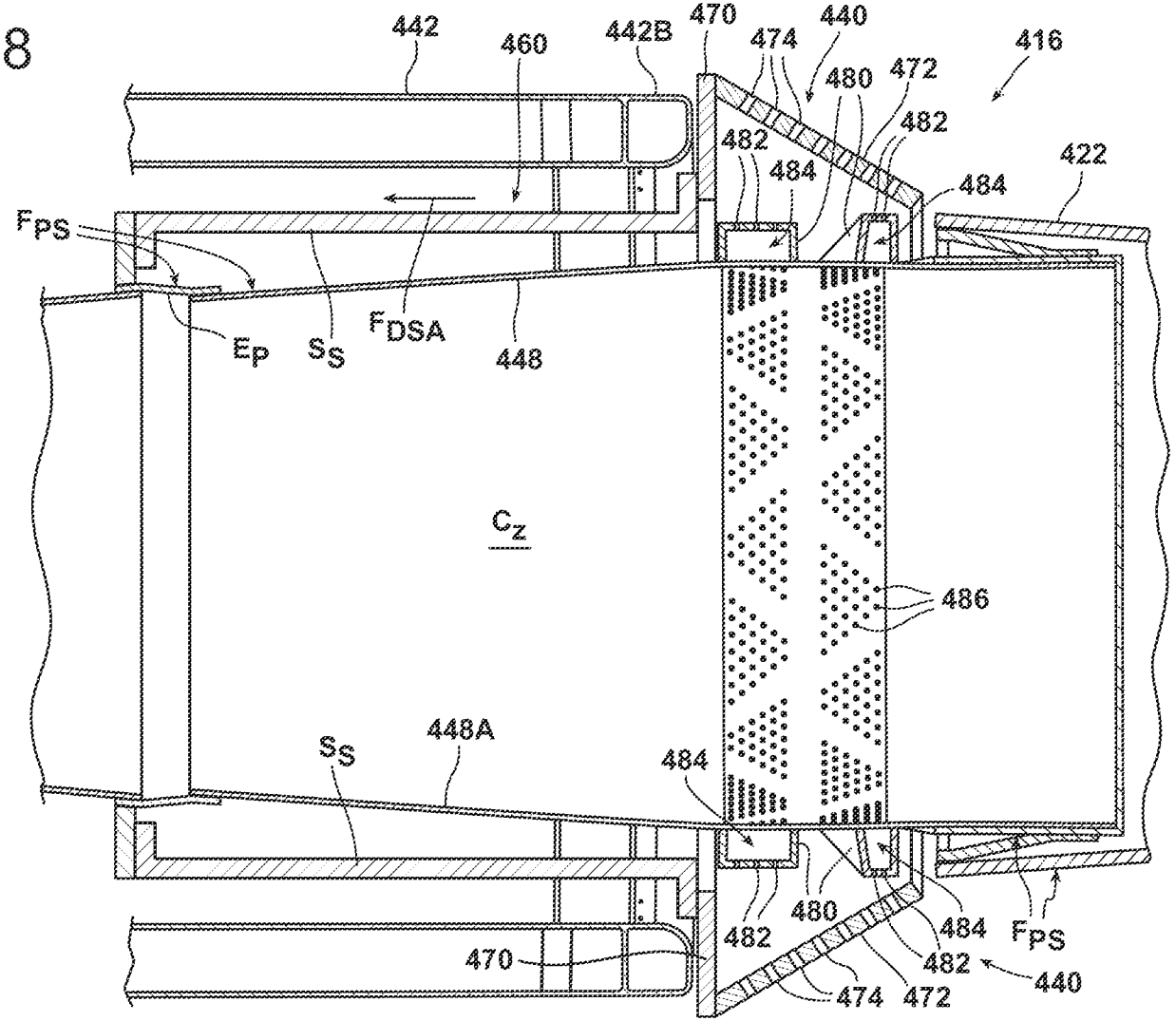

Referring now to FIG. 8, a flow conditioner 440 according to another embodiment of the invention is illustrated, where structure similar to that described above with reference to FIGS. 1-4 includes the same reference number increased by 400. It is noted that only components of the combustor 416 that are different than those of the combustor 16 described above with reference to FIGS. 1-4 will be described herein for FIG. 8, and that the fuel injection system 456 has been removed from FIG. 8 for clarity.

According to this embodiment, the flow conditioner 440 includes a plurality of circumferentially spaced apart support spindles $S_S$ that extend axially from an extension piece $E_P$ of the liner 448 such that the flow conditioner 440 is effectively affixed to the liner 448. It is noted that the support spindles $S_S$ could extend from other components of the flow path structure $F_{PS}$ than the liner 448 without departing from the spirit and scope of the invention. The support spindles $S_S$ structurally support the frame 470 of the flow conditioner 440 adjacent to the flow sleeve 442 and upstream from the resonator boxes 480. As with the embodiments discussed above, the flow conditioner 440 is only coupled to one of the flow path structure $F_{PS}$ and the flow sleeve 442, i.e., the flow conditioner 440 is coupled to the liner 448 but not to the flow sleeve 442 in this embodiment. Hence, thermal growth issues, such as those described above with reference to the embodiment of FIGS. 1-4, are believed to be reduced or avoided by the flow conditioner 440 according to this embodiment.

It is noted that while the flow conditioners 40, 240, 340, 440 illustrated in FIGS. 2-4 and 6-8 extend from the flow path structure $F_{PS}$, and the flow conditioner 140 illustrated in FIG. 5 extends from the flow sleeve 142, these embodiments could be reversed, wherein the flow conditioners 40, 240, 340, 440 illustrated in FIGS. 2-4 and 6-8 could extend from the flow sleeves 42, 242, 342, 442 and the flow conditioner 140 illustrated in FIG. 5 could extend from the flow path structure $F_{PS}$.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A combustor in a gas turbine comprising:

a liner having an interior volume defining a main combustion zone;

a fuel injection system for delivering fuel into the main combustion zone;

a flow sleeve located radially outwardly from the liner and defining, with the liner, a passageway for air to flow on its way to be mixed with fuel from the fuel injection system, wherein the mixture is burned in the main combustion zone to create hot combustion gases;

a transition assembly comprising a transition duct located downstream from the liner with respect to a flow direction of the hot combustion gases out of the combustor toward a turbine section of the engine, the flow direction of the hot combustion gases defining an axial direction; and a flow conditioner affixed to at least one of the liner and the transition assembly and extending to within close proximity of the flow sleeve but not coupled to the flow sleeve, the flow conditioner comprising at least one panel having a configuration such that air is able to pass through the at least one panel on its way to the passageway, wherein at least a substantial portion of the air that enters the passageway for being burned in the main combustion zone passes through the at least one panel wherein: the flow conditioner further comprises a frame; and the at least one panel comprises a plurality of panels secured to the frame wherein the panels are removably secured to the frame such that the panels are capable of being removed and replaced without detaching the frame from a transition ring, wherein each panel can be selected with a desired air permeability such that an amount of air permitted to flow through each respective panel can be controlled.

2. The combustor of claim 1, wherein: the transition assembly further comprises an annular transition ring coupled to the transition duct; and the flow conditioner comprises an annular member that is affixed to the transition ring.

3. The combustor of claim 1, wherein the flow conditioner further comprises a flange that radially overlaps the flow sleeve and is in close proximity to the flow sleeve but is not coupled to the flow sleeve such that the flange creates a seal with the flow sleeve to substantially prevent leakage therebetween.

4. The combustor of claim 3, wherein substantially all of the air that enters the passageway for being burned in the main combustion zone passes through the at least one panel or leaks between the flange and the flow sleeve.

5. The combustor of claim 1, wherein: the at least one panel includes a plurality of holes; and the air that enters the passageway though the at least one panel passes through the holes in the at least one panel.

6. The combustor of claim 1, further comprising a plurality of resonator boxes extending radially outwardly from the liner into the passageway, the resonator boxes including apertures that allow air in the passageway to flow into inner volumes within the resonator boxes.

7. The combustor of claim 6, wherein the liner includes a plurality of apertures that permit air in the inner volumes of the resonator boxes to pass into the interior volume of the liner.

8. The combustor of claim 1, further comprising a plurality of resonator boxes extending radially outwardly from the liner upstream from the flow conditioner and in close proximity to the flow conditioner, the resonator boxes including apertures that allow air to flow into inner volumes within the resonator boxes.

9. A combustor in a gas turbine engine comprising:

a flow sleeve;

a fuel injection system;

flow path structure defining a flow path for hot combustion gases to pass from the combustor into a turbine section of the engine, the flow path structure comprising: a liner having an interior volume defining a main combustion zone and being located radially inwardly from the flow sleeve and defining, with the flow sleeve, a passageway for air to flow on its way to be mixed with fuel from the fuel injection system, wherein the mixture is burned in the main combustion zone to create hot combustion gases; and a transition assembly comprising a transition duct located downstream from the liner with respect to a flow direction of the hot combustion gases through the flow path, the flow direction of the hot combustion gases defining an axial direction; a flow conditioner affixed to one of the flow path structure and the flow sleeve and extending to within close proximity of but not affixed to the other of the flow path structure and the flow sleeve, the flow conditioner comprising: a frame; and a plurality of panels secured to the frame and having configurations such that air is able to pass through the panels on its way to the passageway, wherein: at least a substantial portion of the air that enters the passageway passes through the panels; and the panels are removably secured to the frame such that the panels are capable of being removed and replaced without detaching the flow conditioner from the one of the flow path structure and the flow sleeve.

10. The combustor of claim 9, wherein: the transition assembly further comprises an annular transition ring coupled to the transition duct; and the flow conditioner comprises an annular member that is affixed to the transition ring.

11. The combustor of claim 9, wherein: the flow conditioner further comprises a flange that extends from the frame and radially overlaps and is in close proximity to the flow sleeve but is not coupled to the flow sleeve such that the flange creates a seal with the flow sleeve to substantially prevent leakage therebetween; and substantially all of the air that enters the passageway for being burned in the main combustion zone passes through the panels or leaks between the flange and the flow sleeve.

12. The combustor of claim 9, wherein: the panels include a plurality of holes; and the air that enters the passageway though the panels passes through the holes in the panels.

13. The combustor of claim 12, wherein each panel can be selected with a desired hole configuration such that an amount of air permitted to flow through each respective panel can be controlled.

14. The combustor of claim 9, wherein each panel can be selected with a desired air permeability such that an amount of air permitted to flow through each respective panel can be controlled.

15. The combustor of claim 9, further comprising a plurality of resonator boxes extending radially outwardly from the liner into the passageway, the resonator boxes including apertures that allow air in the passageway to flow into inner volumes within the resonator boxes.

16. The combustor of claim 15, wherein the liner includes a plurality of apertures that permit air in the inner volumes of the resonator boxes to pass into the interior volume of the liner.

17. The combustor of claim 9, further comprising a plurality of resonator boxes extending radially outwardly from the liner upstream from the flow conditioner and in close proximity to the flow conditioner, the resonator boxes including apertures that allow air to flow into inner volumes within the resonator boxes.

* * * * *